US011246461B2

(12) United States Patent
Marietta-Tondin et al.

(10) Patent No.: US 11,246,461 B2
(45) Date of Patent: Feb. 15, 2022

(54) DISPENSER FOR STATIC CENTER-FEED CORELESS ROLL OF SHEET PRODUCT

(71) Applicant: ESSITY OPERATIONS FRANCE, Kunheim (FR)

(72) Inventors: Julien Marietta-Tondin, Marckholsheim (FR); Gilles Cattacin, Colmar (FR); James Taylor, Chelmsford (GB)

(73) Assignee: ESSITY OPERATIONS FRANCE, Kunheim (FR)

( * ) Notice: Subject to any disclaimer, the term of this patent is extended or adjusted under 35 U.S.C. 154(b) by 0 days.

(21) Appl. No.: 14/352,467

(22) PCT Filed: Oct. 18, 2012

(86) PCT No.: PCT/IB2012/002101
§ 371 (c)(1),
(2) Date: Apr. 17, 2014

(87) PCT Pub. No.: WO2013/057572
PCT Pub. Date: Apr. 25, 2013

(65) Prior Publication Data

US 2014/0246450 A1 Sep. 4, 2014

(30) Foreign Application Priority Data

Oct. 21, 2011 (EP) ..... 11008454

(51) Int. Cl.
*A47K 10/38* (2006.01)
*A47K 10/32* (2006.01)

(52) U.S. Cl.
CPC ..... *A47K 10/38* (2013.01); *A47K 10/3818* (2013.01); *A47K 2010/3206* (2013.01)

(58) Field of Classification Search
CPC ..... A47K 10/22; A47K 10/3809; A47K 10/3818; A47K 10/3827; A47K 2201/00
(Continued)

(56) References Cited

U.S. PATENT DOCUMENTS 2,031,851 A * 2/1936 Plunkett ..... B65D 85/04 206/389
3,002,668 A * 10/1961 Castelli ..... 225/52
(Continued)

FOREIGN PATENT DOCUMENTS

EM 0107487 A1 5/1984
EM 0480848 A1 4/1992
(Continued)

OTHER PUBLICATIONS

Office Action dated May 8, 2019 that issued in Canadian Patent Application No. 2,851,031.
(Continued)

*Primary Examiner* — Gene O Crawford
*Assistant Examiner* — Kelvin L Randall, Jr.
(74) *Attorney, Agent, or Firm* — Buchanan Ingersoll & Rooney PC

(57) ABSTRACT

A sheet product dispenser for dispensing a strip of a sheet product from a static center-feed coreless roll of sheet product is disclosed. The roll includes a central cavity. The dispenser includes a container for accommodating the roll, and a dispensing piece which protrudes toward an interior of the container from one end of the container and which includes a guidance between a receiving opening for receiving the strip of sheet product from the roll and a dispensing opening for dispensing the strip of sheet product outside of the dispenser. The dispensing piece is arranged to engage into the central cavity of the roll. The dispensers provide a dispensing opening so that withdrawal of a sheet product is
(Continued)

facilitated by avoiding collapsing or clogging. Furthermore, the dispenser has a compact configuration that gains space during delivery and transportation.

13 Claims, 8 Drawing Sheets

(58) Field of Classification Search
USPC ..... 221/1, 63
See application file for complete search history.

(56) References Cited

U.S. PATENT DOCUMENTS 3,523,653 A * 8/1970 Hansen ..... 242/593
3,539,124 A * 11/1970 Belokin, Jr. ..... 242/597.7
3,749,296 A * 7/1973 Harrison ..... 225/106
4,219,129 A * 8/1980 Sedgwick ..... A47K 10/3818 118/43
4,398,814 A * 8/1983 Muylle ..... B65H 16/00 242/348.4
4,651,895 A * 3/1987 Niske ..... A47K 10/3818 221/63
4,651,896 A 3/1987 Harrell
5,065,924 A 11/1991 Granger
5,141,171 A * 8/1992 Yang ..... A47K 10/3818 206/233
5,263,607 A * 11/1993 Temesvary et al. ..... 221/304
5,273,184 A * 12/1993 Rizzuto ..... A47K 10/3818 221/286
5,490,625 A * 2/1996 Myatt ..... A47K 10/3827 225/47
5,611,455 A * 3/1997 McCreary ..... B65D 83/0841 206/409
5,769,354 A * 6/1998 Lindh ..... A47K 10/3836 242/593
6,082,663 A 7/2000 Tramontina et al.
6,129,240 A * 10/2000 Morand ..... A47K 10/3818 206/409
6,145,782 A 11/2000 King et al.
6,158,614 A * 12/2000 Haines et al. ..... 221/63
6,220,435 B1 * 4/2001 Nobile ..... A47K 10/3818 206/210
6,964,395 B1 * 11/2005 Lewis ..... A47K 10/3818 242/593
D643,750 S * 8/2011 Dietvorst ..... D9/734
7,997,444 B2 * 8/2011 Martins ..... 221/63
8,857,614 B2 * 10/2014 Gordon ..... B65D 83/0805 206/233
10,231,580 B2 * 3/2019 Rozek ..... A47K 10/3818
10,512,370 B2 * 12/2019 Rozek ..... A47K 10/3818
2003/0132237 A1 * 7/2003 Jeffrey Krok ..... A47K 10/3818 221/63
2005/0046314 A1 3/2005 Sellars et al.
2006/0261076 A1 * 11/2006 Anderson ..... A47K 10/3818 221/33
2009/0314794 A1 * 12/2009 Zylka ..... A47K 10/3827 221/45
2010/0032445 A1 * 2/2010 Bunoz ..... 221/45
2010/0176021 A1 * 7/2010 Gordon ..... A47K 10/3818 206/494
2011/0297781 A1 * 12/2011 Peters ..... A47K 10/3818 242/615
2012/0145737 A1 * 6/2012 Ray ..... A47K 10/3818 221/45
2012/0175455 A1 * 7/2012 Denis et al. ..... 242/594
2013/0306669 A1 * 11/2013 Ray ..... A47K 10/24 221/63
2016/0000276 A1 * 1/2016 Rozek ..... A47K 10/3818 242/593
2017/0183144 A1 * 6/2017 Bougie ..... B65D 83/08
2019/0167048 A1 * 6/2019 Rozek ..... A47K 10/3818
2020/0085248 A1 * 3/2020 Rozek ..... A47K 10/3818

FOREIGN PATENT DOCUMENTS

ES 2048000 3/1994
SU 1804313 A3 3/1993
WO WO-9721377 A1 * 6/1997 ..... A47K 10/3818
WO WO-2007/057537 A1 5/2007

OTHER PUBLICATIONS

Office Action dated Jun. 2, 2019 that issued in Indian Patent Application No. 2626/DELNP/2014.
Canadian Office Action dated Jul. 31, 2018 that issued in Canadian patent application No. 2,851,031.
Search Report dated Dec. 1, 2019 in corresponding Brazilian patent application 112014400253.2 (4 pages).
Office Action dated Apr. 28, 2016 in corresponding Russian Patent Application No. 2014-120468 (7 pages) with an English Translation (6 pages).

* cited by examiner

DISPENSER FOR STATIC CENTER-FEED CORELESS ROLL OF SHEET PRODUCT

CROSS-REFERENCE TO PRIOR APPLICATION

This application is a § 371 National Stage Application of PCT International Application No. PCT/IB2012/002101 filed Oct. 18, 2012, which claims priority to EP 11008454.8, filed Oct. 21, 2011, both of which are incorporated herein in their entirety.

TECHNICAL FIELD

Sheet product dispensers and in particular sheet product dispensers for dispensing a strip of a sheet product from a static center-feed coreless roll of sheet product are described herein. Such dispensers find a particular, though non exclusive, application in dispensing paper sheet products.

BACKGROUND

Sheet product dispensers are well known in the art. Sheet product dispensers are generally used for dispensing sheet products such as absorbent tissues, wipes, paper towels or sheets made of any other absorbent or non-absorbent material.

FIGS. 1A, 1B, 2A, 2B and 2C illustrate a drawback of known sheet product dispensers, namely the collapsing and clogging effects when sheet product are dispensed centrally in either a vertical V or horizontal H direction, respectively. The dispenser 1 has a container with a cylindrical housing 2. The cylindrical housing 2 comprises a side wall 21 and a bottom portion 22 which closes a first end of the cylindrical housing 2. A second end of the cylindrical housing 2 is open and can be closed by a lid or cover 3 to form a closed container for storing a source of a sheet product, e.g. a roll of paper 5. The lid 3 comprises a dispensing opening 4, for example in the center of the lid surface of the lid 3. The sheet product can be unwound sheet by sheet 51 from the center of the roll 5. Precuts in the sheet product or cutting means (not shown) may help cutting sheets of predefined or desired lengths, respectively. Typically, the roll 5 is a coreless roll of sheet product. In this case, the central cavity or hollow core region 52 lacks the supporting effect of a core (e.g. a hollow cylinder made of cardboard). This enables unwinding the roll from the center towards the side of the roll (as illustrated by the arrow U). However, this also results in a deformation and collapsing effect (as illustrated by the arrow C) of the roll of sheet product on itself. In a dispenser positioned such as to dispense sheet vertically (FIG. 1A), the sheet product collapses from both sides toward the central cavity 52. In a dispenser positioned such as to dispense sheet horizontally (FIGS. 1B and 2A), the sheet product collapses from the top portion toward the bottom portion. In both cases, there is a tendency of the sheet product to fill-in the central cavity 52 that is not finely and equally defined all along the roll length anymore. This tendency is further enhanced when the central cavity grows as sheets are dispensed from the roll. FIGS. 2B and 2C illustrate that collapsing at the bottom of the dispenser or close to the dispensing opening, respectively, result in the dispenser to be jammed due to the friction between the withdrawn sheet 51 and the collapsed central cavity 52. Further, an additional clogging/stuffing of the dispenser can also occur when multiple sheets are withdrawn simultaneously through the dispensing opening 4.

A dynamic solution to the collapsing effect is known from WO 2007057537 that describes a dispenser, particularly for dispensing toilet paper, comprising a housing for housing a roll of paper, the housing having a front side with a dispensing opening via which the paper is unwound sheet by sheet, and comprising means for locking the front side to the housing. This dispenser is characterized by virtue of the fact that the front side comprises a hatch for accessing the interior of the housing via which the free end of the roll can be removed. A dispenser of this type permits the user to solve problems of paper blocking inside the housing without, however, being able to steal the roll or, in any event, while leaving it in its original shape so that it can still be used. Such a dispenser comprises a push plate arrangement that apply a longitudinal pressure on the roll towards the inner surface of the front face of the dispenser. Said arrangement also prevents the roll from rotating. Further, said arrangement keeps the roll in shape while preventing it from collapsing when the roll is unwound. However, this is a complex dispenser comprising moving parts.

A static solution to the collapsing effect is known from U.S. Pat. No. 6,082,663 that describes an apparatus which dispenses a static centerflow rolled sheet product. The rolled product is disposed within a housing defined by a front side, back side, and side walls. The front side includes an opening through which an end of the rolled sheet product is pulled. A protrusion is defined, for example, on the back side member and extends towards the front side within the housing. The protrusion is disposed and has a length so as to extend into the rolled sheet product center void a sufficient distance to prevent the rolled product from collapsing on itself as the sheet product is withdrawn.

However, such dispensers are subject to clogging or stuffing because multiple sheets can be dispensed through the opening at the same time.

SUMMARY

It is desired to produce a sheet product dispenser that overcomes the above mentioned drawbacks. For example, a sheet product dispenser that avoids, or at least greatly reduces, collapsing effect of the roll of sheet product within the dispenser and/or clogging/stuffing effect during dispensing.

According to one aspect, there is provided a sheet product dispenser for dispensing a strip of a sheet product from a static center-feed coreless roll of sheet product, said roll including a central cavity, the dispenser including:

a container for accommodating the roll, and a dispensing piece which protrudes toward an interior of the container from one end of the container and which includes a guidance between a receiving opening for receiving the strip of sheet product from said roll and a dispensing opening for dispensing the strip of sheet product outside of the dispenser. The dispensing piece is arranged to engage into the central cavity of the roll.

The dispensing piece may include a cylindrical outer wall connected to the guidance, the guidance protruding into the container and tapering towards the interior of the container to a first tapered end defining the receiving opening. The dispensing piece may engage the central cavity of the roll such that the receiving opening is located below a planar cylindrical surface of the roll closest to the dispensing piece.

The receiving opening may have a larger cross-section than the dispensing opening.

The guidance may be cone-shaped with the receiving opening forming the base of the cone-shaped guidance and the dispensing opening forming a second tapered end of the guidance.

The container may include a centering element protruding from another end of the container opposite to the one end of the container, and wherein the centering element may be arranged to engage into the central cavity of the roll.

The centering element may be integrally formed with a bottom portion of the container or formed separately as an insert to be placed on an inner surface of the bottom portion of the container.

The dispensing piece and the centering element each may have a circular cross-section perpendicular to a longitudinal axis of the dispenser.

The dispensing piece and the centering element each may have a length so as to extend into the central cavity a sufficient distance to prevent the roll from collapsing on itself.

The container may include a cylindrical housing with a loading opening for loading the roll and a lid for closing the loading opening of the housing, wherein the lid may be attachable onto the housing in a removable manner for loading the roll into the container or closing the container.

The dispensing piece may be integrally formed with the lid or formed separately as a separate element to be fixed into an opening of the lid.

The dispenser may include means for compressing the roll within the container along at least one of its cylindrical surface. The bottom portion may be arranged outwardly concave so that a center part of the bottom portion is pressed onto one end of the roll inside the housing.

A handle may be attached at the container. The handle may be L-shaped, one leg of the handle being parallel with a side wall of the cylindrical housing.

According to another aspect, there is provided an arrangement including the sheet product dispenser described above and supporting means so as to mount said dispenser at a vertical supporting surface.

According to a further aspect, there is provided a method of dispensing a strip of a sheet product from a static center-feed coreless roll of sheet product loaded into a container of a dispenser, said roll including a central cavity, wherein the method includes:

engaging a dispensing piece into the central cavity of the roll, the dispensing piece protruding from one end of the container towards an interior of the container, the dispensing piece including a guidance between a receiving opening for receiving the strip of sheet product from the roll and a dispensing opening for dispensing the strip of sheet product outside of the dispenser, and causing the sheet product when dispensed to circumvent a tapered end of the guidance before penetrating through the receiving opening, travelling along the guidance and leaving the dispenser through the dispensing opening.

Using the sheet product dispensers described above, it is possible to easily and reliably remove the strip of paper one at a time, even when the source of sheet product has collapsed inside the dispenser due to the continued removal of paper by the user. Thus, clogging or stuffing of the sheet product dispenser may be avoided.

Other advantages will become apparent from the hereinafter description of the invention.

BRIEF DESCRIPTION OF THE DRAWINGS

Embodiments of the present invention are illustrated by way of examples and not limited to the accompanying drawings, in which like references indicate similar elements.

DETAILED DESCRIPTION OF PREFERRED EMBODIMENTS OF THE INVENTION

Figure 1A:
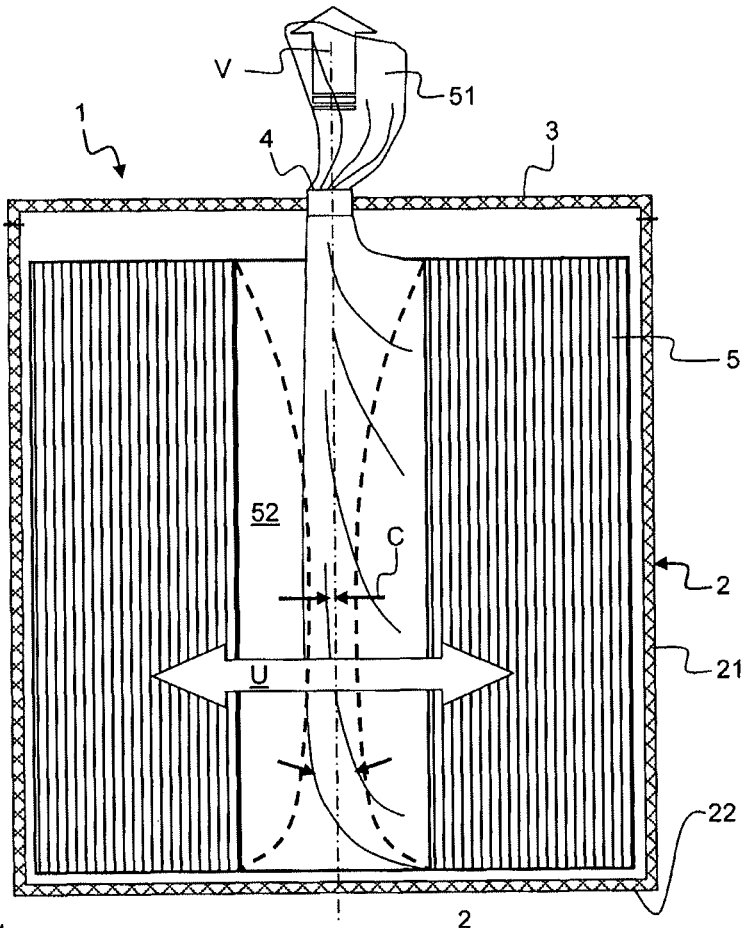
FIGS. 1 and 2 illustrate the collapsing and clogging effects in a dispenser of the prior art dispensing sheet product in either a vertical or horizontal direction.

The following detailed description should be read with reference to the drawings. The drawings depict exemplary embodiments and are not intended to limit the scope of the invention.

In the following description, the terminologies "top", "bottom", "vertical", or "horizontal" are used to explain the position of the various elements relatively to each other according to particular embodiments as depicted in the drawings, and also the operation of the dispenser. This is not intended to limit the use of the dispenser in a particular position. For example, the terminology "top" can be replaced by "front" while "bottom" can be replaced by "back". The dispenser can be used in a vertical, horizontal, even inclined, fixed, or portable manner. The terminology static with respect to the roll is intended to mean that the roll is substantially non-rotating within the housing during the unwinding process.

Figure 1B:
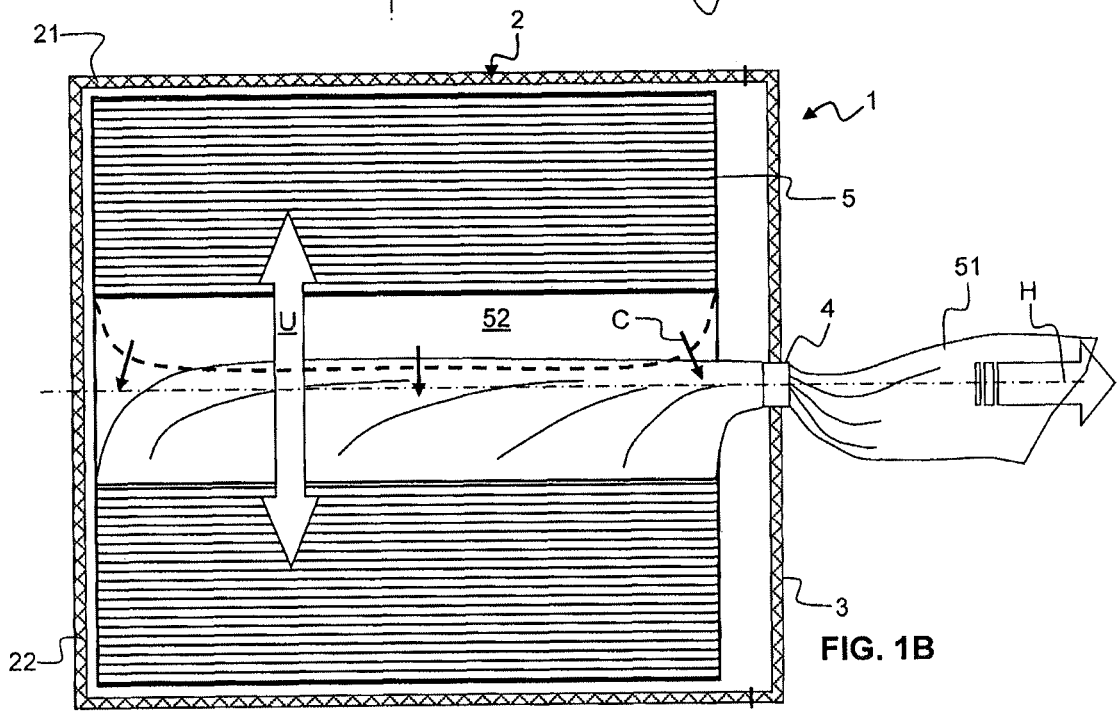
Figure 2A:
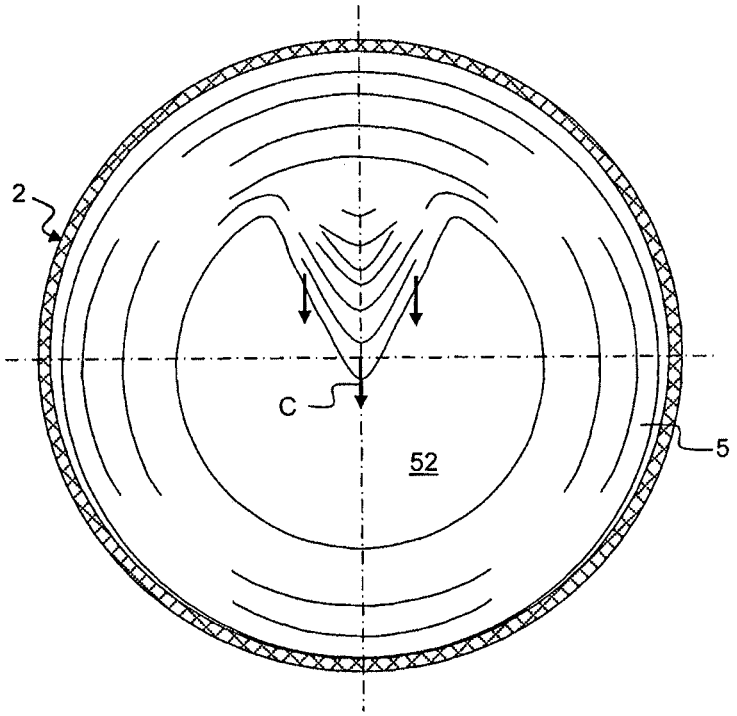
Figure 2B:
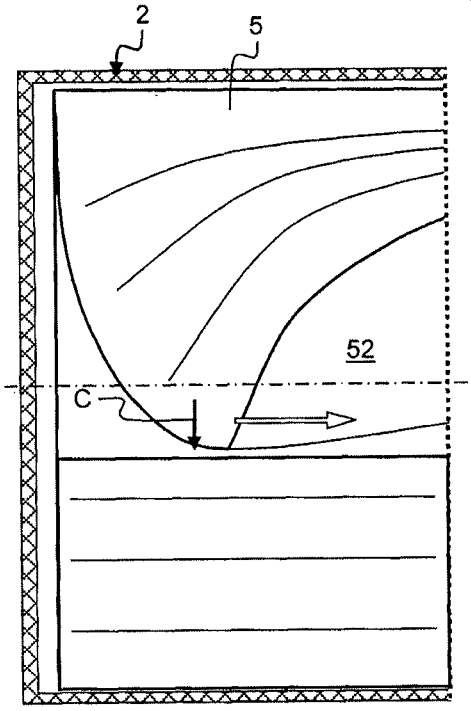
Figure 2C:
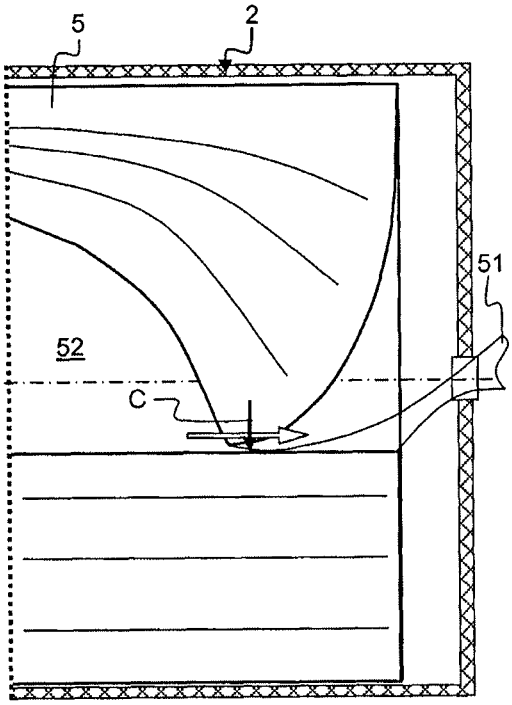
Figure 3:
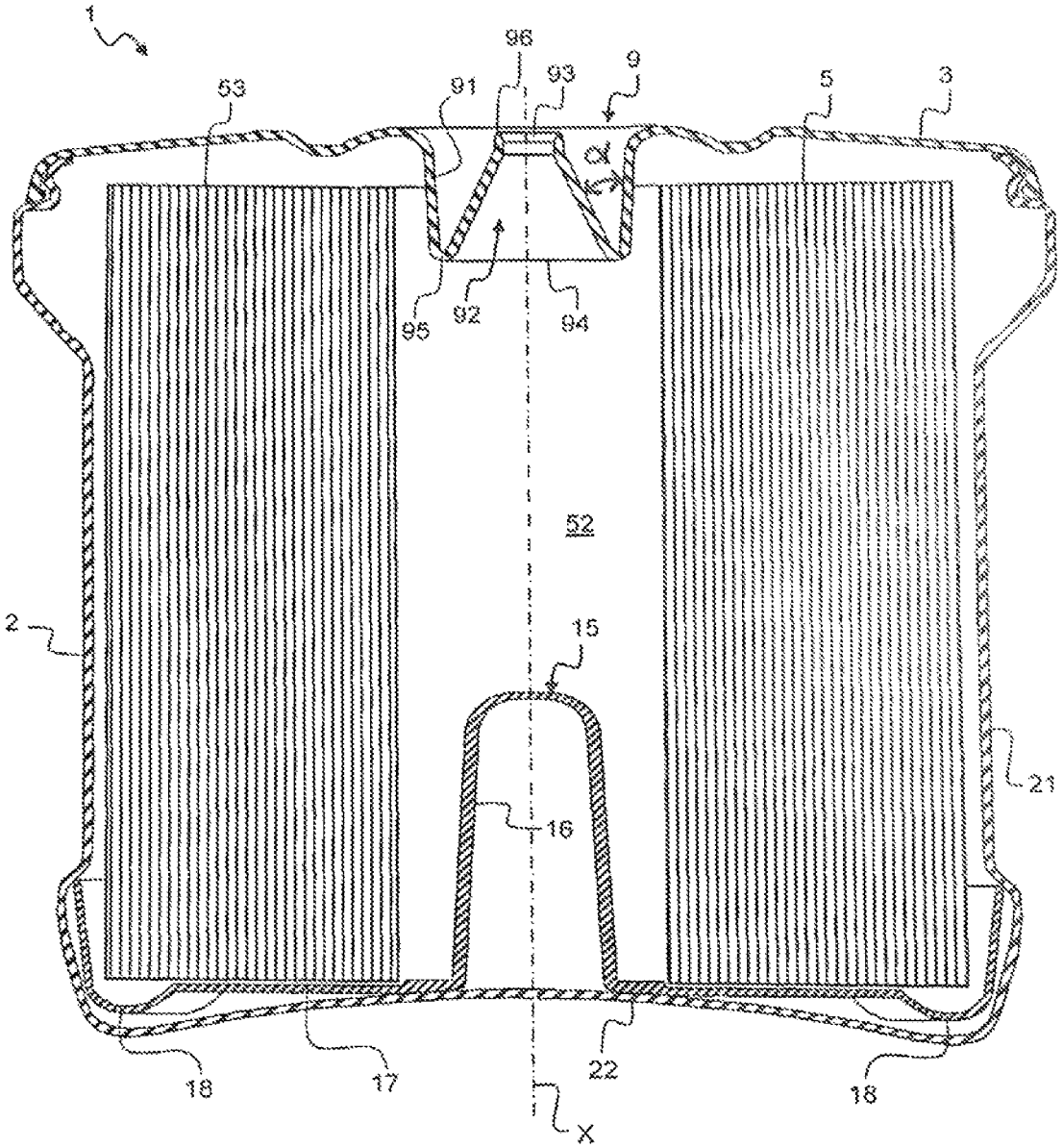
FIG. 3 is a cross-section view illustrating a sheet product dispenser according to an embodiment of the invention.

FIG. 3 shows a cross-sectional view of an embodiment of the sheet product dispenser. Similarly to the embodiment of FIGS. 1 and 2, the dispenser comprises a container with a cylindrical housing 2 and a lid 3. The cylindrical housing 2 comprises a side wall 21 and a bottom portion 22 which closes a first end of the cylindrical housing 2. A second end of the cylindrical housing 2 is open and forms a loading opening and can be closed by the lid 3. The side wall 21 and the bottom portion 2 of the housing 2 can be formed as an integral element, i.e. by known molding and extrusion techniques. The lid 3, formed as a separate element, can be removably attached to the second end of the housing 2 for closing the container and/or loading the container with the sheet product, e.g. the sheet roll 5. The lid 3 has a substantially planar lid surface which is perpendicular to the longitudinal axis X of the cylindrical housing 2. The lid surface is encompassed by a circumferential edge which extends perpendicular from the lid surface. The circumferential edge defines an inner cross-section which is slightly larger than the outer cross-sectional area of the cylindrical housing such that the lid 3 can be attached onto the housing 2 according to various manners known in the art (thread or screwing arrangement, snapping arrangement, hinge arrangement, locking arrangement, etc. . . . ). The lid 3 can be removed so that the interior of the housing 2 is fully opened for loading with a source of a sheet product, e.g. a roll 5. The roll 5 may be made of absorbent or non-absorbent material of a woven or non-woven type. The sheets may be used as wipes, paper towels, toilet paper, cleaning tissues and the like. The individual sheets may be sized as desired to accommodate the many uses of the towels. Furthermore, pre-perforation lines may be formed to allow the user to tear off a sheet after the pre-perforation line has left a dispensing piece 9.

In FIG. 3, the container is shown loaded with a sheet roll 5 so that the sheet roll axis is substantially coaxial or parallel to the longitudinal axis X of the housing 2.

In the dispenser of FIG. 3, a dispensing piece 9 for withdrawal of the strip of sheet product 51 is integrally formed with the lid 3. As an alternative embodiment (not shown), the dispensing piece 9 is formed as a separate element from the lid 3, the dispensing piece 9 being attached to the lid 3 according to any appropriate manner (screwed, snapped, glued, etc. . . . ). The dispensing piece 9 has a cylindrical outer wall 91 which protrudes into the housing 2. The outer wall 91 is substantially parallel to the longitudinal axis X. This further helps supporting the roll 5 closed to the dispensing opening. The outer wall 91 may also be slightly conical which taper towards the interior of the housing 2 to a first tapered end 95. The diameter of the dispensing piece 9 is adapted to the inner diameter of the coreless roll 5 such that the dispensing piece 9 engages the central cavity 52 of the sheet roll 5. This allows the sheet roll 5 to be centered within the housing 2.

The dispensing piece 9 has a guidance 92 which couples the hollow core region 52 of the sheet roll 5 with a dispensing opening 93. The dispensing opening 93 is arranged in the interior of the dispensing piece 9. The dispensing opening 93 can be arranged so that it opens to the outside above the surface of the lid 3, coplanar with the surface of the lid 3 or below the surface of the lid 3. Hence, the dispenser 1 can be vertically stacked onto one another by placing a bottom portion 22 of one dispenser 1 onto the planar surface of the lid 3 of another dispenser 1. The vertical stacking of dispensers may be useful for space efficient storing in packing boxes for storage, shipment and display.

The guidance 92 may be cone-shaped with a receiving opening 94 forming the base of the cone-shaped guidance 92 and the dispensing opening 93 forming a second tapered end 96 (defining some kind of rim) of the guidance 92. This allows sheets 51 to be formed smoothly from the unwound strip of sheet product. The cone-shaped guidance 92 can be connected with an inner end of the outer wall 91 of the dispensing piece 9 at the first tapered end 95 defining the receiving opening 94. Other cross-sectional configurations of the guidance 92 may be possible such as cylindrical, slit-like shapes or the like.

The dispensing piece 9 engages the central cavity 52 of the sheet roll 5 such that the first tapered line 95 defining the receiving opening 94 is located below the upper surface 53 of the roll 5. The upper surface 53 of the roll 5 is the planar cylindrical surface closest to the dispensing piece 9 of the lid 3.

As an example, for a roll having a diameter ranging from 184 to 190 mm, a core diameter of 58 mm, and a height ranging from 192 to 198 mm, a dispensing piece may have a receiving opening of 32 mm, a dispensing opening of 11 mm, a penetrating length of the guidance or cylindrical outer wall length of 32 mm, and cone-shaped guidance angle $\alpha$ with respect to the cylindrical outer wall of 23°. This is an example, as what matter in order to avoid the clogging/stuffing effect as explained hereinafter is that the dispensing piece engages the central cavity of the sheet roll sufficiently to provide a support to a collapsed roll when the roll is almost totally unwound.

To ensure that the axial direction of the roll 5 is substantially held in place, the roll 5 may be compressed along at least one of its planar cylindrical surface (either the one closest to the lid 3, or the one closest to the bottom portion 22). The housing 2 can be structured allowing fixing the roll 5 within the housing 2. For example, the bottom portion 22 can be arranged outwardly concave, so that a center part of the bottom portion 22 is pressed onto one end of the cylindrical sheet roll 5 inside the housing 2 thereby holding the sheet roll 5 between the bottom portion 22 and the lid 3. Such an arrangement also prevents the roll 5 from rotating within the housing 2. It is well adapted to the dispensing of static center-feed roll.

Further, the bottom portion 22 of the housing 2 is provided with a centering element 15. The centering element 15 has a cylindrical outer wall 16 which protrudes into the housing 2. The outer wall 16 may also be slightly conical and tapers towards the interior of the housing 2. The diameter of the centering element 15 is adapted to the inner diameter of the sheet roll 5 such that the centering element 15 engages the central cavity 52 of the sheet roll 5.

The centering element 15 can be formed integrally with the bottom portion 22 of the housing 2 such that the bottom portion 22 has a recess which forms the protrusion of the centering element 15 to the interior of the housing 2. The centering element 15 can be formed in a respective molding process used for manufacturing the housing 2.

Alternatively, the centering element 15 can be formed as a separate part which can be inserted into the interior of the housing 2 so that it is arranged on a slightly convexly shaped or planar inner surface of the bottom part 22. The centering element 15 can be held in the center of the housing 2 by an adjustment element 17. The adjustment element 17 can be disc-shaped and have a diameter substantially corresponding to the inner diameter of the bottom portion 22 of the housing 2. Furthermore, the adjustment element 17 can also be formed by a number of arms radially extending from the outer wall 16 of the centering element 15.

On its radially outer ends the adjustment element 17 may be provided with protrusions 18 extending towards the bottom portion 22. The protrusions 18 can be integrally formed with the adjustment element 17 or can be attached to adjustment element 17. In particular, when used with a housing 2 having a bottom portion 22 which is concave, the protrusions 18 allow a safe position of the centering element 15 to be maintained and prevent the centering element 15 from tilting with respect to the sheet roll axis.

Figure 4:
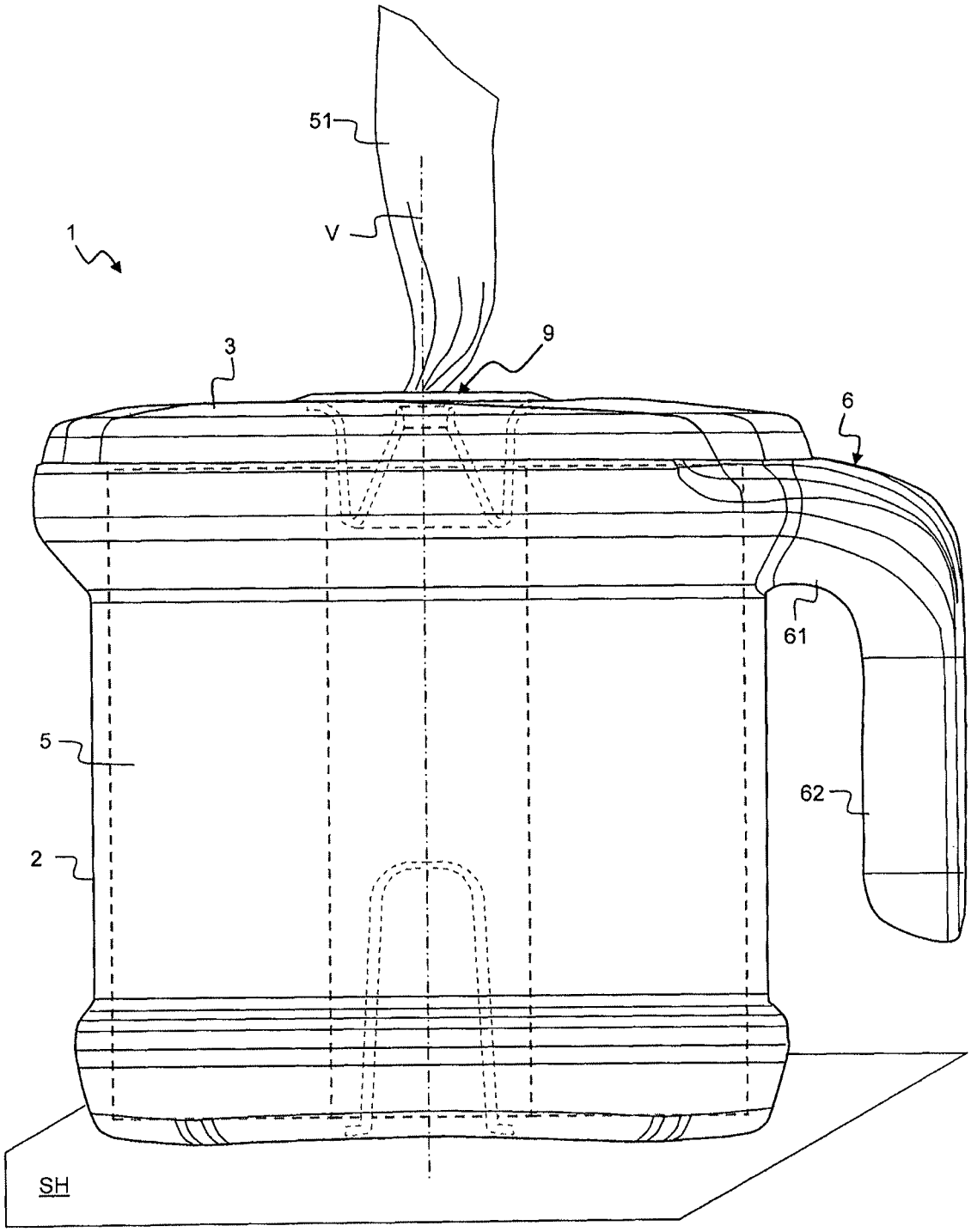
FIG. 4 is a side view of a sheet product dispenser used as a portable dispenser according to an embodiment of the invention wherein sheet product are dispensed in a vertical upside direction.

FIG. 4 is a side and partially transparent view of a sheet product dispenser 1 used as a portable dispenser wherein sheet product are dispensed in a vertical direction V. The sheet product dispenser 1 further comprises a handle 6 for ease of grasping the dispenser. It is arranged to be portable and to be positioned onto a horizontal supporting surface SH, e.g. a table or the like.

The handle 6 is formed to extend beyond the side surface of the housing 2. The handle 6 may have an L-shape comprising a short leg 61 integrally attached to the housing 2 and a long leg 62 extending in parallel to the side wall 21 along the axial direction of the cylindrical housing 2. The handle 6 may be of a tubular shape. The handle 6 dimensions are such that the dispenser can be easily grasped by a hand. The handle 6 can be either attached (U-shaped) or not (L-shaped) to the housing by its end.

Figure 5:
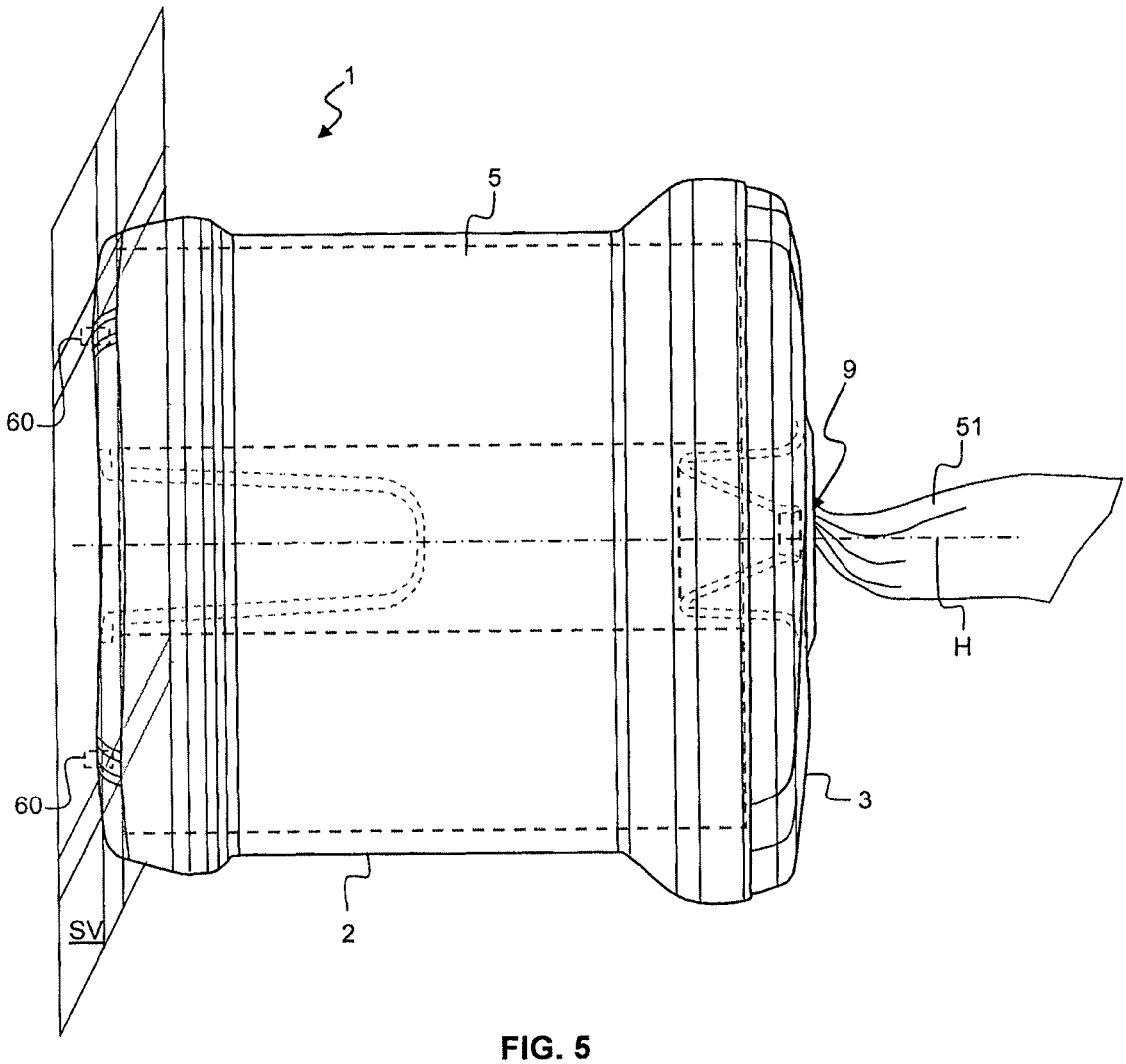
FIG. 5 is a side view of a sheet product dispenser used as a fixed (e.g. wall supported) dispenser according to another embodiment of the invention wherein sheet product are dispensed in a horizontal direction.

FIG. 5 is a side and partially transparent view of a sheet product dispenser 1 used as a fixed dispenser wherein sheet product are dispensed in a horizontal direction H.

Figure 6:
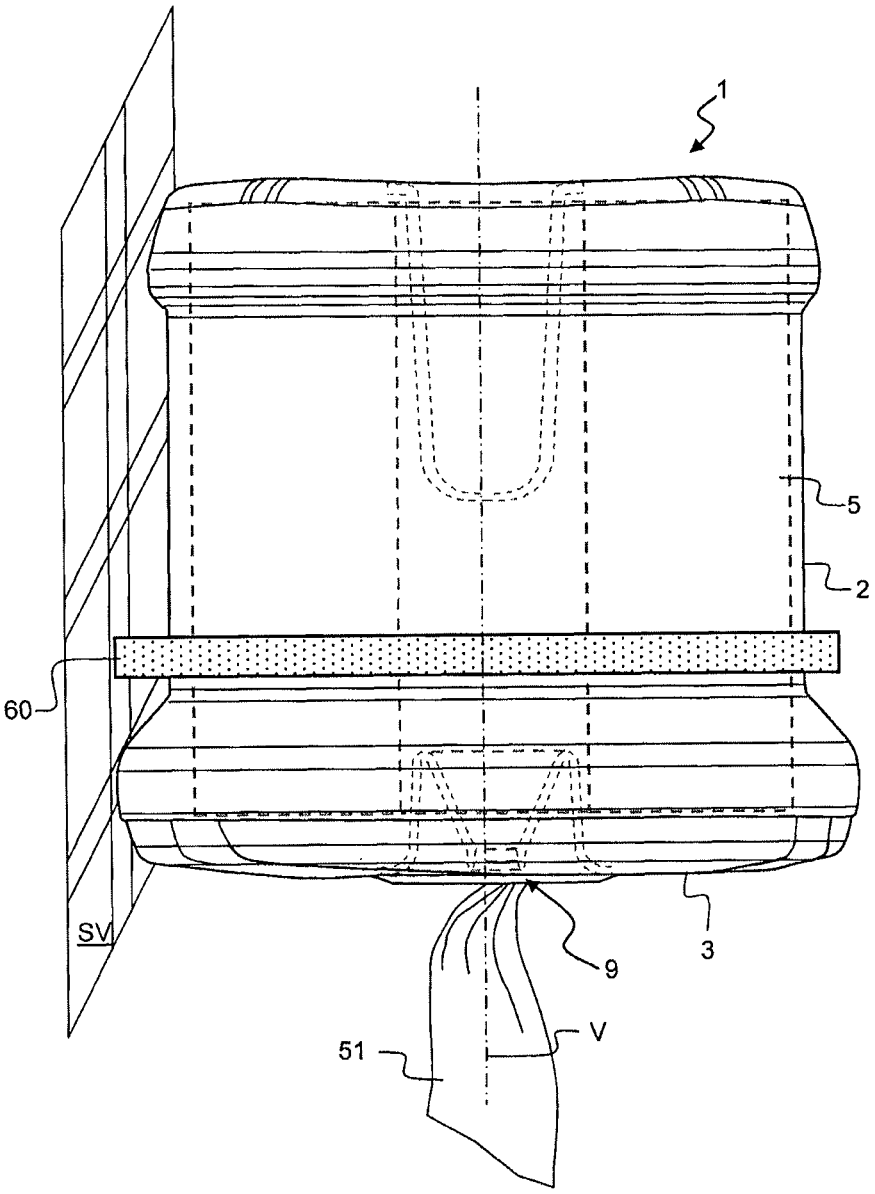
FIG. 6 is a side view of a sheet product dispenser used as a fixed (e.g. wall supported) dispenser according to still another embodiment of the invention wherein sheet product are dispensed in a vertical downside direction.

FIG. 6 is a side and partially transparent view of a sheet product dispenser 1 used as a fixed dispenser wherein sheet product are dispensed in a vertical direction V. The dispensing piece 9 is pointing down towards the bottom.

In both embodiments, the housing 2 of the dispenser is arranged to be mounted onto a vertical supporting surface SV, e.g. a wall, through appropriate supporting means 60 (screwed, glued, or inserted in a specific wall mount or wall holder).

Figure 7:
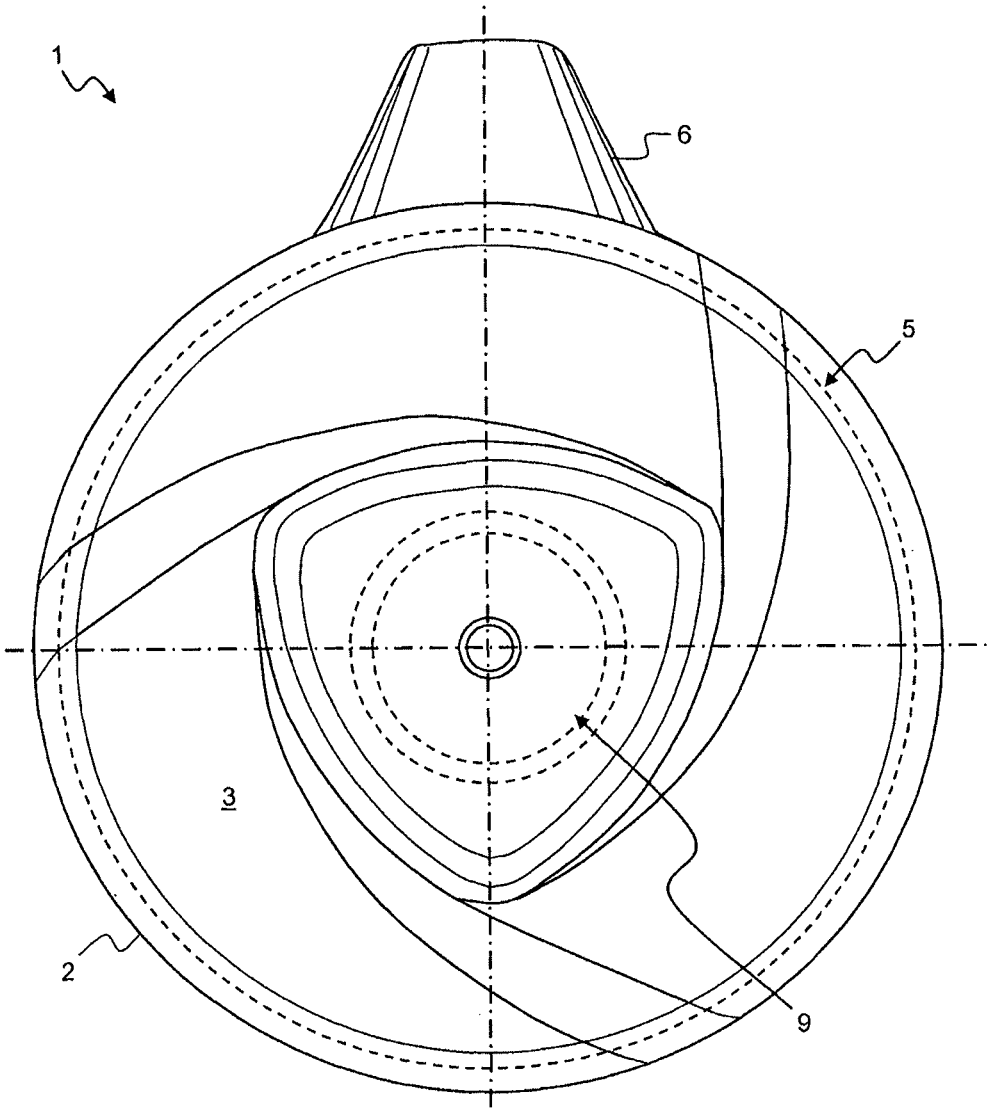
FIG. 7 is a top view of the sheet product dispenser used as a portable dispenser of FIG. 4.

FIG. 7 is a top view of the sheet product dispenser 1 used as a portable dispenser of FIG. 4. A view of a sheet product dispenser 1 used as a fixed dispenser would be similar while lacking the handle 6.

Since the dispenser 1 may be used in environments where moisture, dirt and debris are prevalent, a water resistant design can be used for the dispenser 1 to exclude moisture and dirt from intruding into the interior of the dispenser 1. The housing 2 can be made of plastic and can be manufactured by blow molding, injection molding and the like and may be formed with the handle 6 as an integral product to increase the water tightness of the dispenser 1. The lid 3 may be molded separately and may be made of the same or similar materials as the housing 2.

Figure 8:
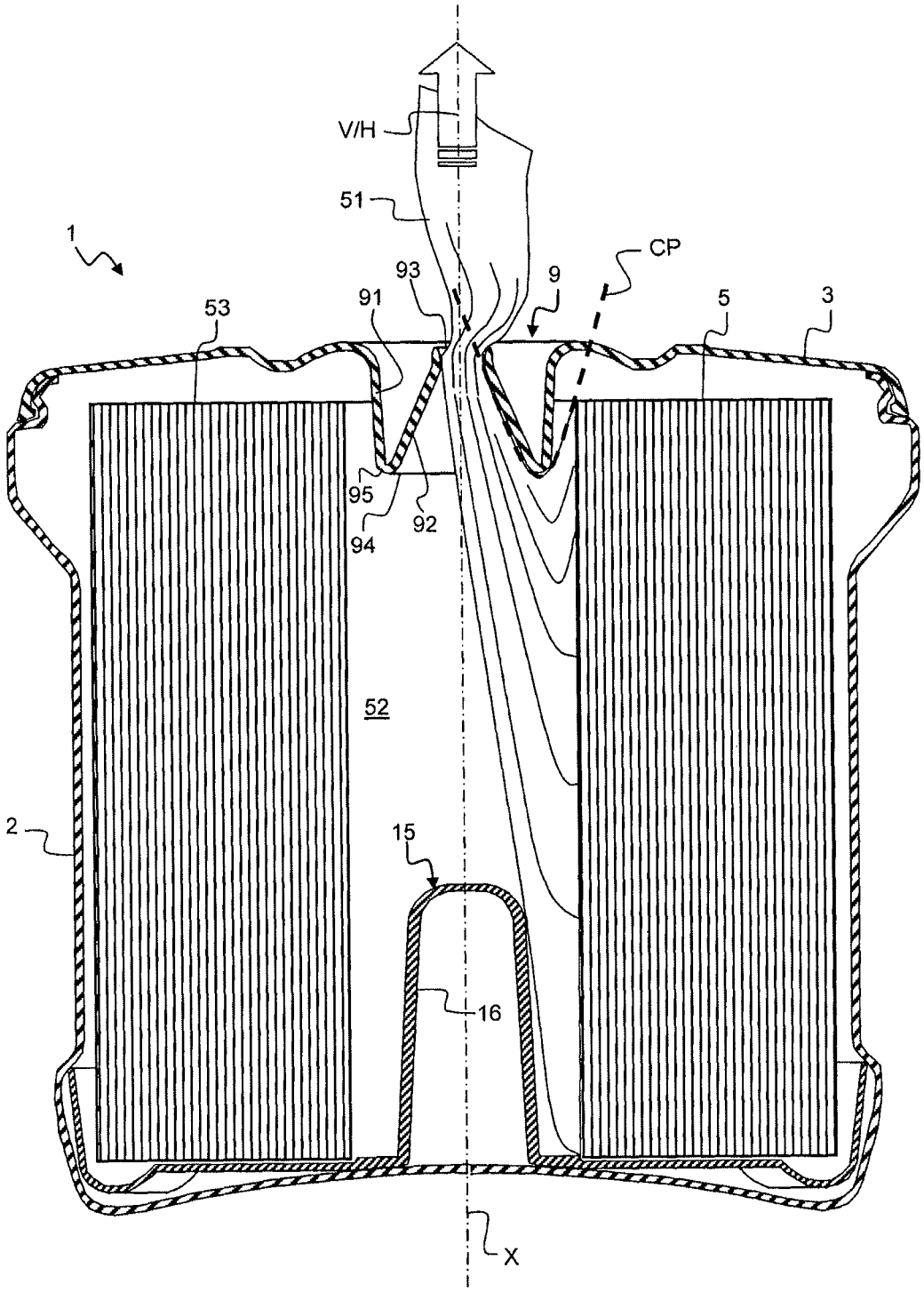
FIG. 8 is a cross-section view illustrating the sheet product dispenser according to FIG. 3 during the dispensing process.

FIG. 8 is a cross-section view illustrating the sheet product dispenser according to FIG. 3 after the sheet product dispenser 1 has been loaded with a roll 5 of sheet product, and during the dispensing process.

During the process of loading a sheet source into the dispenser 1, a roll 5 as the sheet source is put into the open housing 2. The roll 5 may be a paper roll, in particular a center-feed roll, wherein the roll 5 is not provided with a central core, so that a free end in the center portion of the roll 5 is accessible. The roll 5 is positioned with its axis extending coaxially with the axis X of the cylindrical housing 2. The sheet roll 5 is dispensed from its center to its circumference. The sheet roll 5 may be of any size to fit within the housing 2 of the dispenser 1. In order to guide the free end of the strip 51 from the roll 5 through the dispensing opening 93 it can be fed firstly through said opening before the lid 3 is attached onto the housing 2. After the lid 3 is then attached to the housing 2, the free end of the strip 51 can be completely withdrawn from the dispenser 1. The roll 5 of sheet product is unwound as a strip or sheet by sheet 51. Though, FIG. 4 or 6 depicts sheet product dispenser 1 positioned such as to dispense sheets in the vertical direction V, the hereinafter described effects are also applicable to sheet product dispenser 1 positioned such as to dispense sheets in the horizontal direction H (FIG. 5).

On the one hand, the centering element 15 allows the bottom region of the roll 5 to be centered within the housing 2 and, further, avoids, at least reduces the collapsing effect of the roll on itself in the bottom region (as depicted in FIGS. 2A and 2B). Further, it avoids a clogging/stuffing effect via the bottom region of the roll 5.

On the other hand, the dispensing piece 9 allows the top region of the roll 5 to be centered within the housing 2 and, further, avoids, at least reduces the collapsing effect of the roll on itself in the top region (as depicted in FIGS. 2A and 2C). Further, the dispensing piece 9, in particular the cone-shaped guidance 92 connected with the inner end of the outer wall 91 of the dispensing piece 9 at the tapered end 95 below the top surface 53 of the roll 5, causes the unwounded sheet (in the top region) to circumvent the tapered end 95 before penetrating through the receiving opening 94, travelling through the cone-shaped guidance 92 and reaching the dispensing opening 93. The circumventing path is illustrated by the dotted line CP. In particular, this feature combined with the static center-feed unwinding of the roll avoids two of more sheets to adhere to each other and to be dispensed at the same time. Thus, this allows sheets 51 to be formed one by one from the unwound strip of sheet product by avoiding a clogging/stuffing effect via the top region of the roll 5 even at the end of unwinding of the roll 5. In a dispenser comprising only the dispensing piece 9 of the invention (namely not the centering element 15), the dispenser is able to dispense even a collapsed roll in the bottom region without clogging or jamming effect to be noticed.

The centering element 15 in combination with the dispensing piece 9, both engaging the central cavity 52 of the roll 5, enables supporting the sheet roll 5 through its two ends. In a dispenser positioned such as to dispense sheet vertically (FIGS. 4 and 6), the collapsing of sheet product from both sides toward the central cavity 52 is avoided, at least greatly reduced. In a dispenser positioned such as to dispense sheet horizontally (FIG. 5), the collapsing of the sheet product from the top portion toward the bottom portion is avoided, at least greatly reduced. In both case, the tendency of the sheet product to fill-in the central cavity 52 all along the roll length is avoided. Further, the tendency to jam the dispenser by dispensing two or more sheets at the same time is also avoided.

The invention claimed is:

1. A sheet product dispenser for dispensing a strip of a sheet product from a static center-feed coreless roll of sheet product having a central cavity, the dispenser comprising:

a container for accommodating the roll;

a dispensing piece which protrudes toward an interior of the container from one end of the container to engage into the central cavity of the roll, the dispensing piece having a length to extend into the central cavity a sufficient distance to prevent the roll from collapsing on itself, the dispensing piece including:

a cylindrical outer wall extending from outside of the central cavity of the roll into the central cavity of the roll, the cylindrical outer wall being substantially parallel to a longitudinal axis of the container, and a majority of a length of the cylindrical outer wall extending into the central cavity of the roll; and an inclined wall extending between a first tapered end connecting the inclined wall to the cylindrical outer wall and a second tapered end provided opposite the first tapered end and within a region defined by the cylindrical outer wall, the inclined wall being inclined relative to the cylindrical outer wall; and wherein the first tapered end of the inclined wall defines a receiving opening located in the central cavity of the roll for receiving the strip of sheet product from said roll, and the second tapered end of the inclined wall defines a dispensing opening located outside the central cavity of the roll for dispensing the strip of sheet product outside the dispenser, wherein a cross-section of the receiving opening at a location in the central cavity of the roll is larger than a cross-section of the dispensing opening located outside the central cavity of the roll, wherein the inclined wall is cone-shaped with the first tapered end at the receiving opening forming the base of the cone-shaped inclined wall, and wherein an angle of inclination of the cone-shaped inclined wall is substantially constant between the first tapered end at the receiving opening and the second tapered end at a start of the dispensing opening.

2. The product dispenser according to claim 1, further comprising:

a centering element arranged at another end of the container opposite to the one end of the container, the centering element having a wall that protrudes into the central cavity of the roll, wherein the centering element is integrally formed with a bottom portion of the container or formed separately as an insert to be placed on an inner surface of the bottom portion of the container.

3. The product dispenser according to claim 1, wherein the dispensing piece has a circular cross-section perpendicular to a longitudinal axis of the dispenser.

4. The product dispenser according to claim 1, wherein the container comprises a cylindrical housing with a loading opening for loading the roll and a lid for closing the loading opening of the housing, wherein the lid is attachable onto the housing in a removable manner for loading the roll into the container or closing the container.

5. The product dispenser according to claim 4, wherein the dispensing piece is integrally formed with the lid or formed separately as a separate part to be fixed into an opening of the lid.

6. The product dispenser according to claim 1, wherein the dispenser comprises an element that compresses the roll within the container along a cylindrical surface of the roll.

7. The product dispenser according to claim 6, wherein a bottom portion of the container is arranged outwardly concave so that a center part of the bottom portion is pressed onto one end of the roll inside the housing.

8. The product dispenser according to claim 1, wherein a handle is attached to the container.

9. The product dispenser according to claim 8, wherein the container comprises a cylindrical housing, wherein the handle is L-shaped, and wherein one leg of the handle is parallel with a side wall of the cylindrical housing.

10. The product dispenser according to claim 1, wherein the product dispenser is adapted to be mounted onto a vertical supporting surface via supporting means.

11. A method of dispensing a strip of a sheet product from a static center-feed coreless roll of sheet product loaded into a sheet product dispenser, the sheet product dispenser comprising:

a container for accommodating the roll;

a dispensing piece which protrudes toward an interior of the container from one end of the container to engage into a central cavity of the roll, the dispensing piece having a length to extend into the central cavity a sufficient distance to prevent the roll from collapsing on itself, the dispensing piece including:

a cylindrical outer wall extending from outside of the central cavity of the roll into the central cavity of the roll, the cylindrical outer wall being substantially parallel to a longitudinal axis of the container, and a majority of a length of the cylindrical outer wall extending into the central cavity of the roll; and an inclined wall extending between a first tapered end connecting the inclined wall to the cylindrical outer wall and a second tapered end provided opposite the first tapered end and within a region defined by the cylindrical outer wall, the inclined wall being inclined relative to the cylindrical outer wall; and wherein the first tapered end of the inclined wall defines a receiving opening located in the central cavity of the roll for receiving the strip of sheet product from said roll, and the second tapered end of the inclined wall defines a dispensing opening located outside the central cavity of the roll for dispensing the strip of sheet product outside the dispenser, wherein a cross-section of the receiving opening at a location in the central cavity of the roll is larger than a cross-section of the dispensing opening located outside the central cavity of the roll, wherein the inclined wall is cone-shaped with the first tapered end at the receiving opening forming the base of the cone-shaped inclined wall, and wherein an angle of inclination of the cone-shaped inclined wall is substantially constant between the first tapered end at the receiving opening and the second tapered end at a start of the dispensing opening, wherein the method comprises:

engaging the dispensing piece into the central cavity of the roll, the dispensing piece protruding from one end of the container towards an interior of the container; and causing the sheet product when dispensed to circumvent said first tapered end of the inclined wall before penetrating through the receiving opening, travelling along the inclined wall and leaving the dispenser through the dispensing opening.

12. The product dispenser according to claim 1, further comprising:

a centering element arranged at another end of the container opposite to the one end of the container, wherein a wall of the centering element has a cone-like shape that protrudes into the central cavity of the roll.

13. The product dispenser according to claim 1, further comprising:

a centering element arranged at another end of the container opposite to the one end of the container, wherein the centering element includes protrusions that are arranged around an outer periphery of the centering element and the roll, the protrusions protruding towards a bottom portion of the container away from the roll.

* * * * *